US006931967B1

(12) United States Patent
Chang

(10) Patent No.: US 6,931,967 B1
(45) Date of Patent: Aug. 23, 2005

(54) CONNECTING SHAFT DEVICE FOR SCREWS

(76) Inventor: Sheng-Ming Chang, No. 32, Sioushan 5th Rd., Daya Township, Taichung County 428 (TW)

( * ) Notice: Subject to any disclaimer, the term of this patent is extended or adjusted under 35 U.S.C. 154(b) by 0 days.

(21) Appl. No.: 10/788,554

(22) Filed: Feb. 26, 2004

(51) Int. Cl.[7] ..... B25B 23/12
(52) U.S. Cl. ..... 81/451; 81/125
(58) Field of Search ..... 81/451, 125, 177.85, 81/438

(56) References Cited

U.S. PATENT DOCUMENTS 2,671,484 A * 3/1954 Clark ..... 81/451
5,724,873 A * 3/1998 Hillinger ..... 81/451
5,996,452 A * 12/1999 Chiang ..... 81/429
6,154,108 A * 11/2000 Huang ..... 335/284
6,363,819 B1 * 4/2002 Li ..... 81/438
6,497,166 B1 * 12/2002 Fleckenstein ..... 81/451
6,511,268 B1 * 1/2003 Vasudeva et al. ..... 408/239 R
6,530,299 B1 * 3/2003 Liu ..... 81/451
6,666,114 B1 * 12/2003 Lin ..... 81/438

FOREIGN PATENT DOCUMENTS

DE 4243650 A1 * 6/1994 ..... B25B 23/00

* cited by examiner

*Primary Examiner*—David B. Thomas
(74) *Attorney, Agent, or Firm*—Charles E. Baxley

(57) ABSTRACT

The present invention of a connecting shaft device for screws mainly comprises a sliding sleeve having a magnetic element disposed on the inner circumference of the front end, the sliding sleeve is then sleeved on a connecting shaft and can slide on it, the sliding distance is controlled by an elastic element, a slant groove and a groove, the structure is simple and can temporarily position a screw, hold the screw in locking position and at the same time can also control the depth of locking.

2 Claims, 2 Drawing Sheets

CONNECTING SHAFT DEVICE FOR SCREWS

BACKGROUND OF THE INVENTION

Conventional clamping device for screws usually includes a clamping part, the clamping part having a handle for receiving pneumatic or electric tools, a shaft body with a space inside for inserting a tool shaft. The shaft body having a sliding sleeve at its front end for pressing a steel ball against a groove disposed on the middle part of the tool shaft, the sliding sleeve is pressed against by a spring to keep it in position, can slide the spring to let the steel ball to have room to move backwards, so that the tool shaft can be released to disconnect from the clamping device. The tool shaft having dual-connecting ends with its one end having a receiving hole for connecting a tool head, another end having an outer threading, a nut is sleeved on the outer threading, an inner threading of an outer sleeve is also sleeved on the outer threading. The front end of the outer threading of the tool shaft having a hole for the tool head, the front end of the outer threading inside the outer sleeve having an elastic element and a screw attraction element. The screw attraction element having a magnet and a pad. Accordingly, the outer sleeve can adjust the depth of the locking mechanism, and can press against the nut for positioning purpose, for clamping different tools. The structure is quite complicated. Besides, it cannot fix the tool head and also position the screw and adjust the depth of locking at the same time.

SUMMARY OF THE INVENTION

The present invention of a Connecting Shaft Device for Screws comprises a connecting shaft and a sliding sleeve, a magnetic element is disposed on the inner circumference of the front end, the sliding sleeve is sleeved on the connecting shaft to slide on it, the sliding distance is controlled by an elastic element and a slant groove, the structure is simple and can temporarily position a screw, hold the screw and control the depth locking mechanism at the same time.

The present invention will become more fully understood by reference to the following detailed description thereof when read in conjunction with the attached drawings.

DETAILED DESCRIPTION OF THE PREFERRED EMBODIMENT

Figure 1:
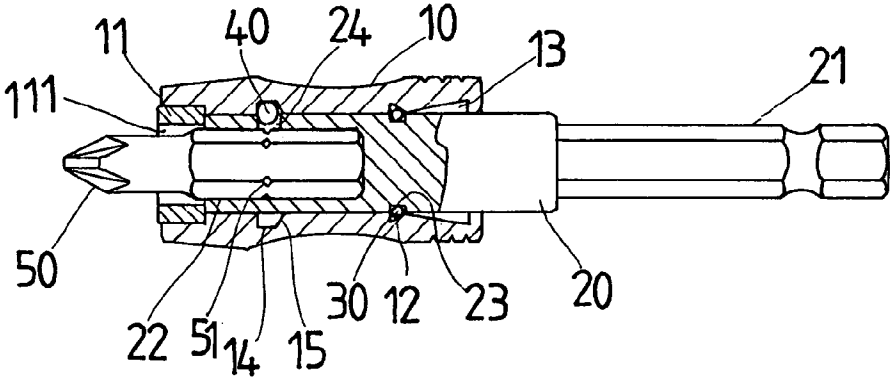
FIG. 1 is a sectional view of a first embodiment of the present invention.

Referring FIG. 1, the present invention of a Connecting Shaft Device for Screws mainly comprises a sliding sleeve 10, a magnetic element 11 is disposed on the inner circumference of a front hole of the sliding sleeve 10. The magnetic element having a through hole 111, a front positioning slant groove 12 and a rear positioning slant groove 13 are disposed inside the sliding sleeve 10 according to the sliding distance of a connecting shaft 20. The connecting shaft 20 having a hexagonal shaft section 21 disposed at its rear end. The hexagonal shaft section 21 is for connecting to a clamping head of a pneumatic tool. The front end of the connecting shaft 20 having a tool head connecting hole 22, the connecting shaft 20 also having a groove 23 and an elastic element 30 is sleeve on it.

The elastic element 30 is in C-shape which is sleeved on the groove 23 of the connecting shaft 20, and the sliding sleeve 10 is sleeved on the connecting shaft 20, so that the sliding sleeve 10 can slide to the front and rear slant grooves 12 and 13, and is pressed against and positioned by the elastic element 30, so that the sliding range of the sliding sleeve 10 is limited.

Figure 2:
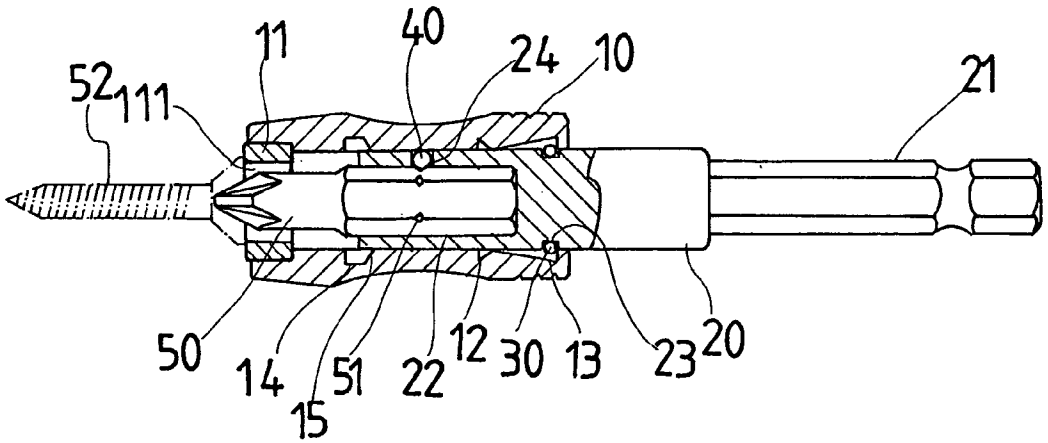
FIG. 2 is a sectional view of the first embodiment in operation of the present invention.

Referring to FIG. 2, the connecting shaft 20 having the groove 23 and the elastic element 30 is sleeved on it. The front end of the connecting shaft 20 having the tool head connecting hole 22 and the hexagonal shaft section 21 is disposed at its rear end. The magnetic element 11 is disposed on the inner circumference of a front hole of the sliding sleeve 10, and the slant grooves 12 and 13 are disposed inside the sliding sleeve for limiting the sliding distance. The connecting shaft 20 having a placement hole 24 for placing a steel ball 40, the sliding sleeve 10 having a slant surface 15 and a ring groove 14 for the steel ball 40 to return back. The sliding sleeve 10 having the front positioning slant groove 12 and rear positioning slant groove 13, for a tool head 50 to slide forwards and backwards and be positioned, so that the connecting shaft 20 can lock the tool head 50 in position. The tool head 50 having a concave dot 51 for the steel ball 40 to place into.

Accordingly, slide the sliding sleeve 10 backwards to position the elastic element 30 into the front positioning slant groove 12, and the steel ball 40 is inserted into the ring groove 14 so that the tool head 50 is unlocked and can be taken out.

When the sliding sleeve 10 pushes the tool head 50 forwards to make it insert into the head of a screw 52, the magnetic element 11 can stably attract the screw 52, for easy locking and also allows control of the depth of locking.

Figure 4:
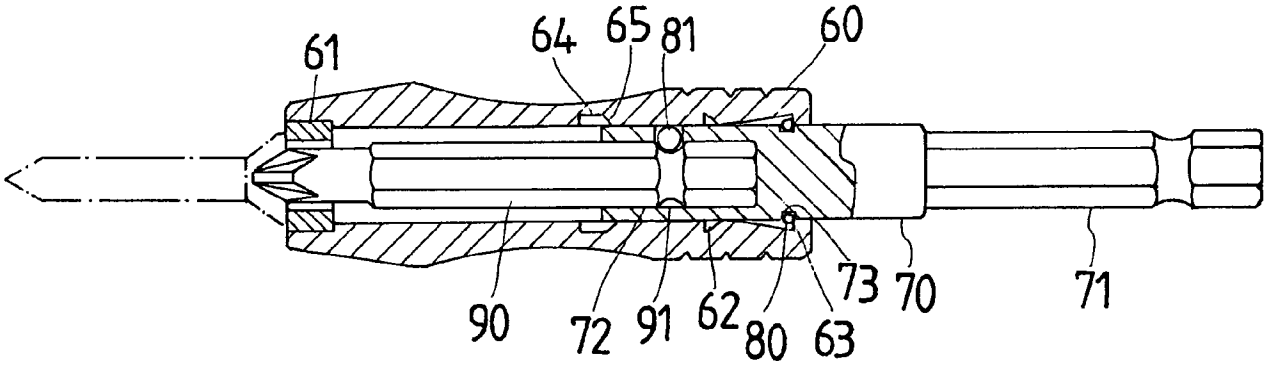
FIG. 4 is a sectional view of the second embodiment in operation of the present invention.
Figure 3:
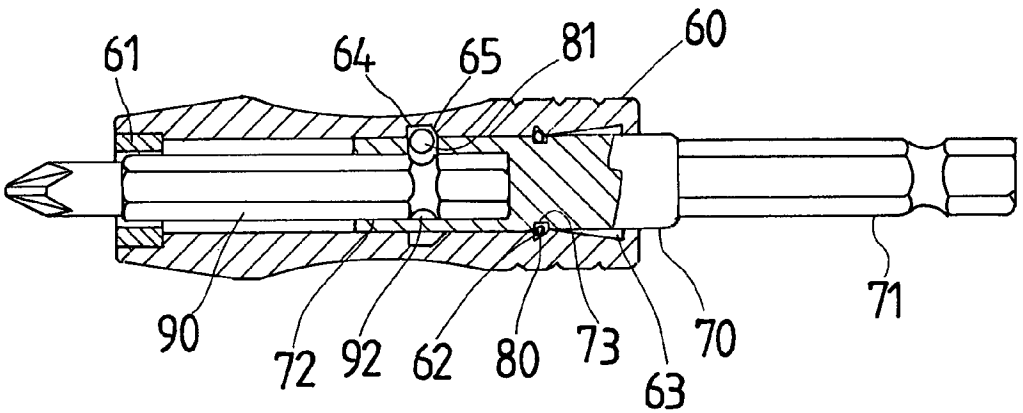
FIG. 3 is a sectional view of a second embodiment of the present invention.

Referring to FIGS. 3 and 4, the connecting shaft device for screw comprises a sliding sleeve 60, a magnetic element 61 is disposed on the inner circumference of a front hole of the sliding sleeve 60, a front positioning slant groove 62 and a rear positioning slant groove 63 are disposed inside the sliding sleeve 60 according to the sliding distance of a connecting shaft 70. The connecting shaft 70 having a hexagonal shaft section 71 disposed at its rear end. The hexagonal shaft section 71 is for connecting to a clamping head of a pneumatic tool. The front end of the connecting shaft 70 having a tool head connecting hole 72, the connecting shaft 70 also having a groove 73 and an elastic element 80 is sleeve on it. The elastic element 80 is in C-shape which is sleeved on the groove 73 of the connecting shaft 70, and the sliding sleeve 60 is sleeved on the connecting shaft 70, so that the sliding sleeve 60 can slide to the front and rear slant grooves 62 and 63, and is pressed against and positioned by the elastic element 80. The connecting shaft 70 having a placement hole 74 for placing a steel ball 81, the sliding sleeve 60 having a slant surface 65 and a ring groove 64 for the steel ball 81 to return back. A tool head 90 having a groove 91 in corresponding to the steel ball 81, so that the steel ball 81 is locked into the groove 91 in order to lock the tool head 90 into position and will not easy to fall out.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A connecting shaft device comprising:

a connecting shaft including a rear end having a hexagonal shaft section disposed thereon, and including a front end having a tool head connecting hole disposed thereon, and including a groove formed thereon, and including a placement hole formed therein and communicating with said tool head connecting hole thereof, an elastic element engaged in said groove of said connecting shaft, a steel ball engaged in said placement hole of said connecting shaft, a tool head receivable in said tool head connecting hole of said connecting shaft, and including a concave dot for receiving said steel ball, a sliding sleeve slidably engaged onto said connecting shaft, and including slant grooves formed therein for receiving said elastic element, to determine front and rear limiting positions of said sliding sleeve relative to said connecting shaft, said sliding sleeve including a ring groove and a slant surface formed therein, for receiving said steel ball, and for selectively forcing said steel ball into said tool head connecting hole of said connecting shaft, and into said concave dot of said tool head, and thus to selectively lock said tool head to said connecting shaft, when said sliding sleeve is slid and moved relative to said connecting shaft, and said tool head being unlocked from said connecting shaft when said steel ball is received in said placement hole of said connecting shaft, and a magnetic element disposed in a front end of said sliding sleeve, and including a through hole formed therein, for slidably receiving said tool head, and for attracting a screw to said tool head.

2. A connecting shaft device comprising:

a connecting shaft including a rear end having a hexagonal shaft section disposed thereon, and including a front end having a tool head connecting hole disposed thereon, and including a groove formed thereon, and including a placement hole formed therein and communicating with said tool head connecting hole thereof, an elastic element engaged in said groove of said connecting shaft, a steel ball engaged in said placement hole of said connecting shaft, a tool head receivable in said tool head connecting hole of said connecting shaft, and including a groove for receiving said steel ball, a sliding sleeve slidably engaged onto said connecting shaft, and including slant grooves formed therein for receiving said elastic element, to determine front and rear limiting positions of said sliding sleeve relative to said connecting shaft, said sliding sleeve including a ring groove and a slant surface formed therein, for receiving said steel ball, and for selectively forcing said steel ball into said tool head connecting hole of said connecting shaft, and into said groove of said tool head, and thus to selectively lock said tool head to said connecting shaft, when said sliding sleeve is slid and moved relative to said connecting shaft, and said tool head being unlocked from said connecting shaft when said steel ball is received in said placement hole of said connecting shaft, and a magnetic element disposed in a front end of said sliding sleeve, and including a through hole formed therein, for slidably receiving said tool head, and for attracting a screw to said tool head.

* * * * *